US007061378B2

(12) United States Patent
Lawrenson et al.

(10) Patent No.: US 7,061,378 B2
(45) Date of Patent: Jun. 13, 2006

(54) PERSONAL PROPERTY ALARM SYSTEM

(75) Inventors: Frank Ralph Lawrenson, Ipswich (GB); Adam Edmund Palmer Coxen, London (GB)

(73) Assignee: Boardbug Limited, London (GB)

( * ) Notice: Subject to any disclaimer, the term of this patent is extended or adjusted under 35 U.S.C. 154(b) by 207 days.

(21) Appl. No.: 10/472,164

(22) PCT Filed: Mar. 20, 2002

(86) PCT No.: PCT/GB02/01330

§ 371 (c)(1),
(2), (4) Date: Mar. 15, 2004

(87) PCT Pub. No.: WO02/077938

PCT Pub. Date: Oct. 3, 2002

(65) Prior Publication Data

US 2004/0145471 A1 Jul. 29, 2004

(30) Foreign Application Priority Data

Mar. 22, 2001 (GB) ..... 0107414.5

(51) Int. Cl.
*G08B 13/14* (2006.01)

(52) U.S. Cl. ..... 340/568.1; 340/571

(58) Field of Classification Search ..... 340/568.1, 340/571, 539.1, 825.49, 686.6
See application file for complete search history.

(56) References Cited

U.S. PATENT DOCUMENTS 5,748,083 A 5/1998 Rietkerk
5,838,234 A 11/1998 Roulleaux-Robin
5,936,527 A * 8/1999 Isaacman et al. ..... 340/572.1
5,963,131 A * 10/1999 D'Angelo et al. ..... 340/568.1
6,133,830 A * 10/2000 D'Angelo et al. ..... 340/571
6,239,700 B1 * 5/2001 Hoffman et al. ..... 340/539.13
6,265,974 B1 * 7/2001 D'Angelo et al. ..... 340/568.1

FOREIGN PATENT DOCUMENTS

| | | |
|---|---|---|
| CN | 2056528 U | 4/1990 |
| CN | 1275354 A | 12/2000 |
| GB | 2 228 814 | 5/1990 |
| GB | 2 292 627 | 2/1996 |

* cited by examiner

*Primary Examiner*—John Tweel, Jr.
(74) *Attorney, Agent, or Firm*—Woodard, Emhardt, Moriarty, McNett & Henry LLP

(57) ABSTRACT

The present invention relates to a personal property alarm system for monitoring the security of personal property using two-way coded radio signalling. The system comprises an alarm unit to be fixed to an item of property to be protected and a personal unit to be carried by a property owner. The alarm unit and the personal unit each comprise a transceiver to transmit and receive signals between each other. The alarm unit also comprises a motion sensor that is activated by predetermined movement of the property. The personal unit is operable in an alarm mode in which an alarm is activated to alert the property owner. The alarm unit is normally operable in a standby mode and is switched from the standby mode to an emergency mode when the motion sensor is activated. The personal unit alarm mode is activated when its transceiver receives an emergency signal from the alarm unit or when no standby signal has been received from the alarm unit. A personal unit may be tuned to communicate with a plurality of alarm units and/or a plurality of other personal units.

19 Claims, 3 Drawing Sheets

PERSONAL PROPERTY ALARM SYSTEM

CROSS-REFERENCE TO RELATED APPLICATIONS

This application is a 371 National Stage application of PCT/GB02/01330, filed Mar. 20, 2002.

FIELD OF THE INVENTION

The present invention relates to a personal property alarm system and more particularly, but not exclusively, to such a system for monitoring the security of personal property using coded radio signalling.

BACKGROUND OF THE INVENTION

Over the twenty-year period from 1977 to 1997 the number of crimes recorded by the UK Home Office increased by over 75%, with crimes against property accounting for 91% of all recorded crimes in 1997. Personal property is therefore increasingly at risk of being stolen or interfered with at any time, particularly when left unattended or out of view. Effective methods of monitoring the security of personal property are therefore greatly in need.

An example of such a personal property alarm system is disclosed in GB-A-2228814 (Magrill). The Magrill system comprises a radio transmitter unit, retained by the property owner, and a radio receiver unit, fixed to the property to be secured. When in use, the transmitter unit emits a constant signal that is received by the receiver unit. Both the transmitter and receiver units incorporate motion detectors. This system is designed to alert the property owner, by way of a loud audible tone emitted from the receiver unit, if their property is moved and the signal received by the receiver from the transmitter falls below a predefined strength or is absent. While the strength of the signal received by the receiver remains constant no alarm sounds. If the transmitter unit remains stationary for a certain period of time, the transmitted signal is curtailed to conserve power. If the transmitter unit is subsequently moved, its motion detector re-activates the transmitter and signal transmission is resumed. While the receiver unit remains stationary no alarm sounds, even if the transmitter unit moves away from the property. If the receiver unit is subsequently moved, its motion detector re-activates the receiver and it awaits a signal from the transmitter. If no signal is received or its strength diminishes, the alarm sounds. The Magrill system allows manual adjustment of the motion detector sensitivity, duration and/or loudness of the alarm and operational range.

A further example of a personal property alarm system is disclosed in FR-2608868 (Estienne). The Estienne system comprises a transmitter unit in radio communication with a receiver unit. The transmitter emits a constant series of pulses to be received by the receiver. While the frequency of pulses remains at a predefined value, no alarm sounds. If the frequency of pulses received by the receiver changes, the alarm is triggered. The frequency rate expected by the receiver, and transmitted by the transmitter, can be manually adjusted. The operational range of the system is also adjustable.

Both the Magrill and Estienne systems both use a simple one-way transmitter/receiver radio communication monitoring system. The use of such a simple system restricts its operational flexibility and allows the security of only one item of personal property to be monitored per transmitter unit.

BRIEF SUMMARY OF THE INVENTION

It is an object of the present invention to obviate or mitigate the aforesaid disadvantages.

According to the present invention there is provided a personal property alarm system comprising an alarm unit to be fixed to an item of property to be protected and a personal unit to be carried by a property owner, the alarm unit and the personal unit each comprising a transceiver to transmit and receive signals between each other, the alarm unit comprising a motion sensor that is activated by predetermined movement of the property; the alarm unit being operable in an emergency mode and a standby mode; in the emergency mode the transceiver of the alarm unit sends an emergency signal to the transceiver of the personal unit; in the standby mode the transceiver of the alarm unit sends a standby signal to the transceiver of the personal unit; the personal unit is operable in an alarm mode in which an alarm is activated to alert the property owner; wherein the alarm unit is normally operable in said standby mode and is switched from standby mode to the emergency mode when the motion sensor is activated; and wherein the personal unit alarm mode is activated when its transceiver receives an emergency signal from the alarm unit or when no standby signal has been received from the alarm unit for a predetermined period.

The provision of an alarm unit that is able to send signals to the personal unit enables an alarm in the personal unit (and therefore on or about the property owner) to be activated.

Preferably the personal unit has a control device which is operable to send a signal, via the transceiver, to reset the alarm unit from emergency mode to standby mode. The use of two-way signalling greatly increases the operational flexibility of the system and allows the property owner to customize the system to meet his or her personal requirements.

The control device is preferably operable to send a signal to adjust the sensitivity of the motion sensor. Additionally, the control device may be operable to send a signal to request that a standby signal is transmitted from the alarm unit. Alternatively or additionally, the standby signal may be sent at pre-selected time intervals. The emergency signal is thus generated in the event that a standby signal is demanded by the control device on the personal unit and the signal is not sent within a predetermined time period or a standby signal is not received at the pre-selected time interval The alarm mode preferably has two states, one for when it receives an emergency signal and one for when it has not received a standby signal.

Preferably the personal unit has a control device which is operable to transmit an off signal to the alarm unit instructing the alarm unit to enter a quiescent mode, wherein the alarm unit does not send a standby signal but is switched from the quiescent mode to the emergency mode when the motion sensor is activated.

The control device may comprise a switch, a microphone or a combination thereof to enter operating instructions.

Preferably the alarm unit is tuned to communicate with a specific personal unit. Additionally, a plurality of alarm units may be provided, each tuned to one personal unit.

The alarm may comprise an audible tone, a light-emitting display, a means for vibrating the personal unit, or a combination of these features. The personal unit may comprise a received signal strength indicator and/or a directional antenna for detecting the direction from which signals are received from the alarm unit.

BRIEF DESCRIPTION OF THE DRAWINGS

A specific embodiment of the present invention will now be described, by way of example only, with reference to the accompanying drawings in which.

DETAILED DESCRIPTION OF THE INVENTION

Figure 1:
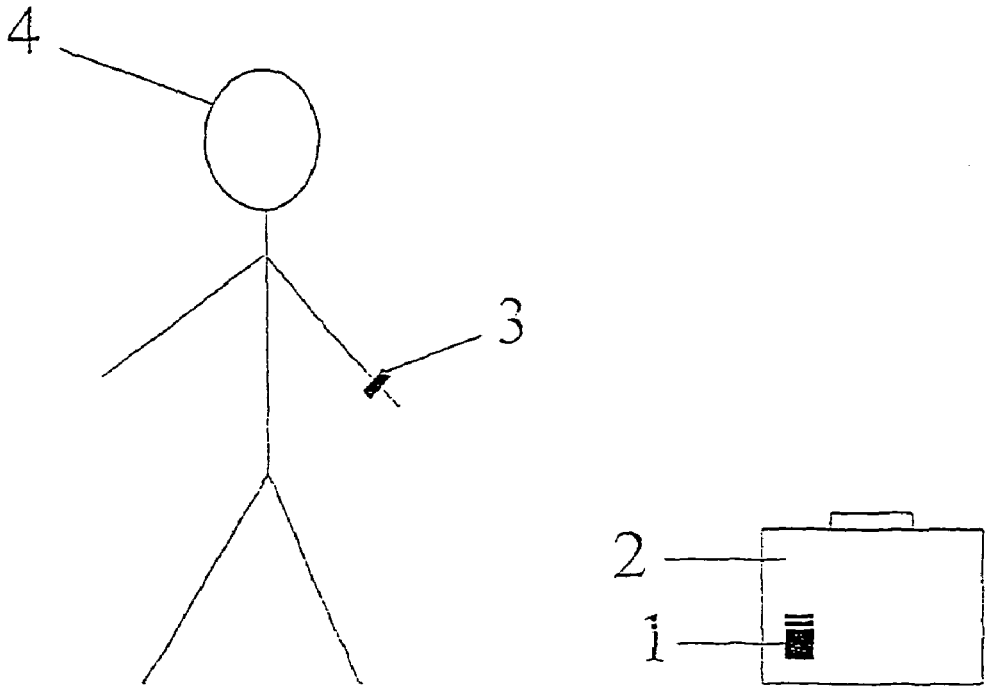
FIG. 1 is a schematic representation of the personal property alarm system of the present invention.

Referring now to FIG. 1, the system comprises an alarm unit 1 fixed to the property 2 to be protected and a personal unit 3 which is worn (e.g. as a watch) or carried (e.g. as a key fob) by the property owner 4.

Figure 2:
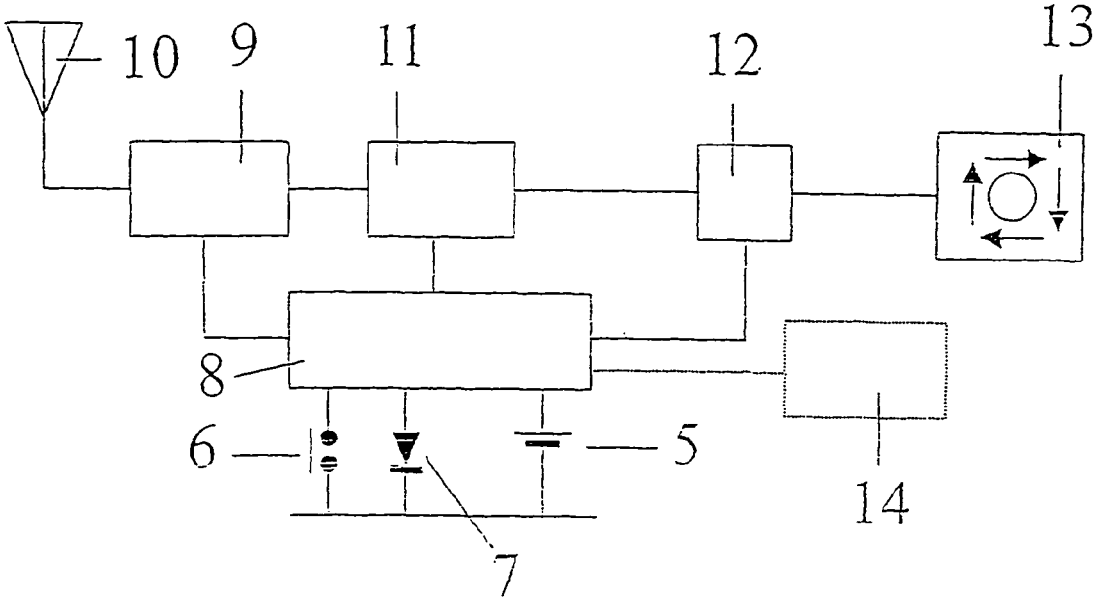
FIG. 2 is a block circuit diagram representing the alarm unit of the present invention.

With reference to FIG. 2, the alarm unit is powered by a battery 5 and is switched on and off via a manual switch 6. An LED indicator 7 indicates the status of the unit. The power is supplied via a power controller 8 to a radio transceiver 9 and associated antenna 10, a microcontroller 11 and signal conditioning/discrimination circuitry 12. A motion sensor in the form of, for example, a piezo-accelerometer 13 is connected to the signal conditioning circuitry 12. The unit may optionally be provided with a solar powered battery 14 (shown in dotted line).

Figure 3:
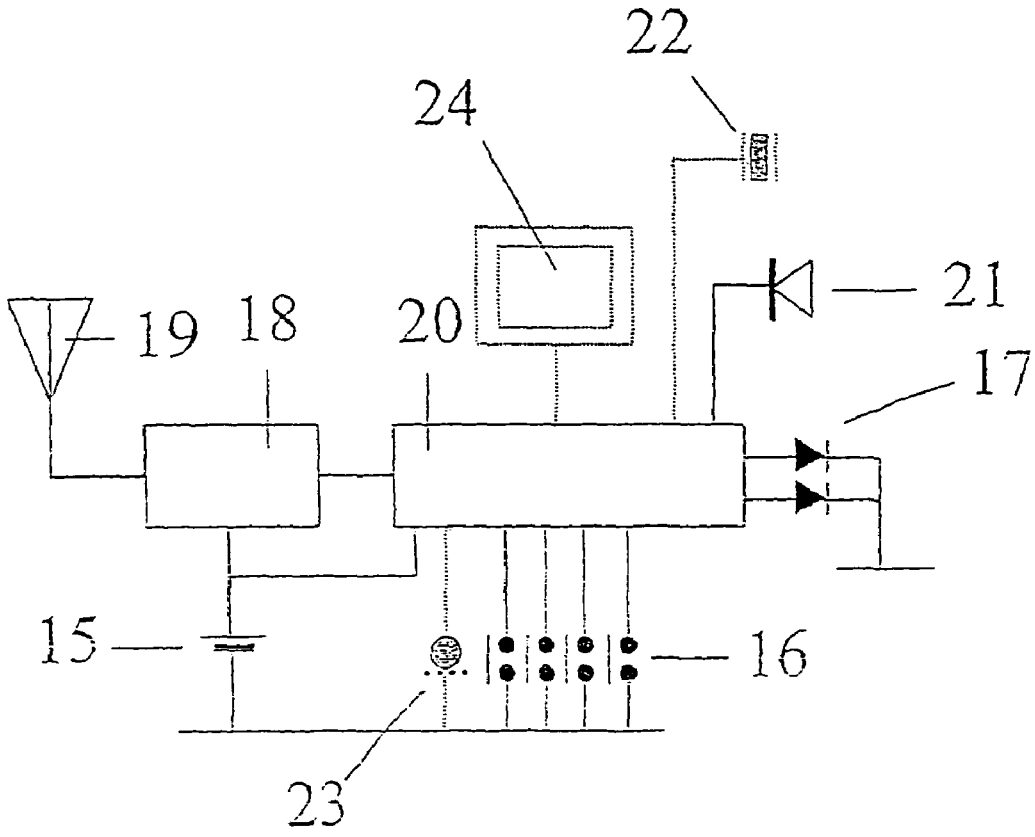
FIG. 3 is a block circuit diagram representing the personal unit of the present invention.

With reference to FIG. 3, the personal unit is powered by a battery 15 and is operated by the user via the manual switches 16. The LED indicators 17 indicate the status of the unit. The power is supplied to a radio transceiver 18 and associated antenna 19, and a micro-controller 20. The micro-controller 20 is connected to an audible alarm 21. The unit may optionally be provided with a vibrating alerter 22, microphone 23 and/or visual display 24 (for example a liquid crystal display).

A method of operation of the system will now be described, by way of example only, with reference to the accompanying drawings.

When switched on for the first time the alarm unit 1 awaits a set-up transmission from the transceiver 18 of a personal unit 3. The set-up transmission includes a unique security number (hereinafter referred to as the "call sign") identifying the personal unit 3 in question. Upon receipt of the call sign the alarm unit 1 stores it and transmits its own specific call sign for storage by the personal unit 3. The alarm and personal units 1, 3 are thus tuned to communicate with one another. The alarm unit is thus set so that it will only respond to and transmit to that personal unit. The set-up transmission is such that it is not necessary for the user to remember the unique security numbers of the alarm or the personal unit.

This initial two-way signal communication enables a specific link to be established between any number of alarm and personal units. For security reasons, each call sign will comprise, for example a 24 bit binary string allowing the use of over 16 million different numbers.

If the alarm unit 1 has previously been tuned to recognise a call sign from a specific personal unit 3 then the alarm unit 1 will only respond to a signal from that personal unit 1. Should such a signal be received, the alarm unit 1 transmits its own call sign to indicate to the personal unit 3 that it is ready for operation.

In operation the alarm unit 1 operates in a quiescent (off) state where it conserves power until the switch 6 is operated by the user to turn on the alarm unit 1. The switch 6 is, for example, a capacitive touch switch, but other types may be used. Once the alarm unit is turned on, the LED indicator 7 is illuminated for a predefined length of time to indicate the unit is ready for operation. If no signal is received from a personal unit 3 within that predefined time limit, the alarm unit 1 reverts to the quiescent (off) state to conserve power.

Once the link has been established, the user can adjust aspects of the operation of the system e.g. the sensitivity of the motion detector 13 or other parameters (discussed below). The user may perform this operation by entering instructions from the personal unit either manually using the data input switches 16 and/or vocally via the microphone 23 (the micro-controller is loaded with appropriate voice recognition software). The instructions are transmitted by the personal unit transceiver 18 and when received by the alarm unit transceiver 9, a return signal is transmitted by the alarm unit transceiver 9 back to the personal unit transceiver 18 to confirm that the instructions have been successfully received and processed.

Following any adjustments made to the system, the alarm unit transceiver 9 then proceeds to transmit a standby signal at regular intervals to the personal unit transceiver 18 to indicate it is operational and the property is secure. The interval between standby signals may be set to a predetermined period by the user via the personal unit. Receipt of a standby signal is relayed to the user by the personal unit 3 by means of the display 24, audible alarm 21, or LED indicators 17, or any combination of these features. In the event that no signal is received in an expected time window the personal unit alerts the user by generating an audible, visible and/or vibrating alarm.

Transmission of the standby signals continues for a predefined length of time, after which, if no movement is detected by the motion detector 13, the alarm unit 1 automatically turns off and reverts to the quiescent (off) state. Prior to turning off, the alarm unit transceiver 9 sends a warning signal to the personal unit transceiver 18 informing the user that the standby signals from the alarm unit transceiver will soon cease. If the user wishes the standby signals to continue, instructions to that effect can be issued to the alarm unit transceiver using the data input switches 16 or the microphone 23 on the personal unit.

In the event that movement is detected by the motion detector 13 the output signal of the detector is compared with a predefined threshold (set by the user via, for example, the control switches 16 on the personal unit) and if it exceeds the threshold, the alarm unit transceiver 9 transmits an alarm signal to the personal unit transceiver 18. Upon reception of the alarm signal, the personal unit alerts the user by generating a visual, audible or other alarm. Examples of the alarm include generation of a suitable representation on the display 24, activation of the audible alarm 21, LED indicators 17, vibrating alerter 22, or any combination of these features. This alarm may be the same as or distinguishable from that generated in the event that a standby signal is not received when expected. The predefined threshold for the motion sensor is ideally selected by the manufacturer or user to discriminate between the movement caused by, for example, the property falling over or being buffeted by the wind and movement that is caused by theft or tampering with the property.

The alarm unit transceiver 9 will continue to transmit the alarm signal until a reset signal is received from the personal unit transceiver 18 instructing it to stop or until the alarm unit power supply falls below the level at which signal transmission is possible. The instruction to transmit a stop signal to the alarm unit transceiver is generated by the user using the data input switches 16 or the microphone 23 on the personal unit 3. The alarm unit then reverts to transmitting standby signals.

The user may check the security status of the alarm unit at any time during operation by entering instructions from the personal unit 3 using the data input switches 16 or the microphone 23. The security status will then be assessed by the alarm unit and transmitted back to the personal unit transceiver. The information is relayed to the user by means of the display 24, audible alarm 21, LED indicators 17, vibrating alerter 22, or any combination of these features. Failure to receive a signal back from the alarm unit transceiver following a security status check will cause the personal unit to alert the user (by means of the display 24, audible alarm 21, LED indicators 17, vibrating alerter 22, or any combination of these features) that no such signal has been received.

The personal unit may be used in combination with a plurality of alarm units in which case it is provided with sufficient memory storage capacity so that the call sign for each of a plurality of alarm and/or personal units can be stored in a discrete memory location. This would allow a single personal unit to be used to monitor the security of a plurality of items of personal property and/or communicate with a plurality of other personal units. "Untuned" alarm units could be sold and then tuned by the user, in the manner described above, to operate with his/her unique personal unit. Once tuned, it prevents an unauthorized person in possession of another personal unit from switching on the alarm unit.

The personal unit may also be provided with sufficient memory storage capacity in the micro-controller 20 to store a plurality of messages, each in a discrete memory location, to be transmitted to the alarm units. The messages may be pre-set (by the manufacturer of the personal unit) within the memory of the personal and/or entered by the property owner using the data input switches 16 or the microphone 23 on the personal unit. This enables a single personal unit to monitor the several items of property. The personal unit may also be configured in the same manner to communicate with other personal units using, for example, text messages. The personal unit data switches 16 would in such an instance be configured in the form of a keypad of the kind that is well-known from mobile telephone technology.

In a further embodiment it is envisaged that the personal unit may have a received radio strength indicator (RSSI) of known configuration, thereby allowing the strength of the received signal to be relayed to the user. If a directional antenna (for detecting the direction from which signals are received from the alarm unit) were used in combination with an RSSI, this would allow the system to perform location/tracking operations where each party has a personal unit and one party is tracking or attempting to locate another. This version of the system would be particularly advantageous for a situation where, for example, a parent and child have become separated in a crowd. An estimate of the distance between the two parties can be derived from the strength of the received signal indicator.

It is to be appreciated that numerous modifications to the above described design may be made without departing from the scope of the present invention as defined in the appended claims. For example, the manual switch on the alarm unit may be replaced with a remote control switch operated by the personal unit.

The invention claimed is:

1. A personal property alarm system comprising an alarm unit to be fixed to an item of property to be protected and a personal unit to be carried by a property owner, the alarm unit and the personal unit each comprising a transceiver to transmit and receive signals between each other, the alarm unit comprising a motion sensor that is activated by predetermined movement of the property; the alarm unit being operable in an emergency mode and a standby mode; in the emergency mode the transceiver of the alarm unit sends an emergency signal to the transceiver of the personal unit; in the standby mode the transceiver of the alarm unit sends a standby signal to the transceiver of the personal unit; the personal unit is operable in an alarm mode in which an alarm is activated to alert the property owner; wherein the alarm unit is normally operable in said standby mode and is switched from standby mode to the emergency mode when the motion sensor is activated; and wherein the personal unit alarm mode is activated when its transceiver receives an emergency signal from the alarm unit or when no standby signal has been received from the alarm unit within a predetermined time period.

2. A personal property alarm system according to claim 1, wherein the personal unit has a control device which is operable to send a signal to reset the alarm unit from emergency mode to standby mode.

3. A personal property alarm system according to claim 1, wherein the personal unit has a control device which is operable to send a signal to adjust the sensitivity of the motion sensor by setting the predetermined movement required to activate the motion sensor.

4. A personal property alarm system according to claim 1, wherein the personal unit has a control device which is operable to send a signal to request a standby signal from the alarm unit.

5. A personal property alarm system according to claim 1, wherein the personal unit alarm has two states, one for when it receives an emergency signal and one for when it has not received a standby signal.

6. A personal property alarm system according to claim 1, wherein the standby signal is sent at predetermined time intervals.

7. A personal property alarm system according to claim 1, wherein the personal unit has a control device which is operable to transmit an off signal to the alarm unit instructing the alarm unit to enter a quiescent mode, wherein the alarm unit does not send a standby signal in the standby mode but is switched from the quiescent mode to the emergency mode when the motion sensor is activated.

8. A personal property alarm system according to claim 2, wherein the control device comprises a switch, a microphone or a combination of these features to enter operating instructions.

9. A personal property alarm system according to claim 1, wherein the alarm unit is tuned to communicate with a specific personal unit.

10. A personal property alarm system according to claim 1, wherein a plurality of alarm units are tuned to one personal unit.

11. A personal property alarm system according to claim 1, wherein the alarm comprises an audible tone, a light-emitting display or a means for vibrating the personal unit, or a combination of these features.

12. A personal property alarm system according to claim 1, wherein the personal unit comprises a received signal strength indicator.

13. A personal property alarm system according to claim 1, wherein the personal unit comprises a directional antenna for detecting the direction from which signals are received from the alarm unit and/or from another personal unit.

14. A personal property alarm system according to any claim 1, wherein the personal unit is tuned to send and receive signals to/from another personal unit.

15. A personal alarm system according to claim 1, where the alarm unit is tuned to a plurality of personal units.

16. A personal property alarm system according to claim 2, wherein the personal unit has a control device which is operable to send a signal to adjust the sensitivity of the motion sensor by setting the predetermined movement required to activate the motion sensor.

17. A personal property alarm system according to claim 16, wherein the the personal unit has a control device which is operable to send a signal to request a standby signal from the alarm unit.

18. A personal property alarm system according to claim 2, wherein the personal unit alarm has two states, one for when it receives an emergency signal and one for when it has not received a standby signal.

19. A personal property alarm system according to claim 18, wherein the standby signal is sent at predetermined time intervals.

* * * * *